US011028663B1

(12) United States Patent
Cargol, Jr. et al.

(10) Patent No.: US 11,028,663 B1
(45) Date of Patent: Jun. 8, 2021

(54) PROCESS AND APPARATUS FOR INSTALLING A PAYLOAD ONTO A SUBSEA STRUCTURE

(71) Applicant: TRENDSETTER ENGINEERING, INC., Houston, TX (US)

(72) Inventors: Patrick Michael Cargol, Jr., Houston, TX (US); Brett Morry, Houston, TX (US); Weili Guo, Houston, TX (US)

( * ) Notice: Subject to any disclaimer, the term of this patent is extended or adjusted under 35 U.S.C. 154(b) by 22 days.

(21) Appl. No.: 16/686,996

(22) Filed: Nov. 18, 2019

(51) Int. Cl.
*E21B 33/038* (2006.01)
*E21B 33/037* (2006.01)
*E21B 41/04* (2006.01)
*E21B 33/064* (2006.01)

(52) U.S. Cl.
CPC ..... *E21B 33/038* (2013.01); *E21B 33/037* (2013.01); *E21B 33/064* (2013.01); *E21B 41/04* (2013.01)

(58) Field of Classification Search
CPC .... E21B 33/038; E21B 33/037; E21B 33/064; E21B 41/04
USPC ..... 166/338
See application file for complete search history.

(56) References Cited

U.S. PATENT DOCUMENTS 7,882,794 B2 * 2/2011 Baylot ..... B63B 27/08 114/312
8,430,171 B2 * 4/2013 Cochrane ..... E21B 33/134 166/363
8,720,580 B1 5/2014 Lugo
9,033,051 B1 5/2015 Lugo
9,038,728 B1 5/2015 Lugo
9,074,447 B1 * 7/2015 Cox ..... E21B 41/0007
9,080,411 B1 7/2015 Lugo
9,340,942 B2 * 5/2016 Luppi ..... E21B 43/0122
9,359,852 B2 6/2016 Kebadze
2006/0042800 A1 * 3/2006 Millheim ..... E21B 33/035 166/344
2013/0020086 A1 * 1/2013 Anderson ..... E21B 33/064 166/339
2014/0374116 A1 * 12/2014 Kelso ..... E21B 41/04 166/345
2016/0207593 A1 * 7/2016 Baylot ..... B63B 22/20
2016/0251817 A1 * 9/2016 Kebadze ..... E21B 33/035 405/224
2017/0350210 A1 12/2017 Lugo
2020/0003025 A1 * 1/2020 Maher ..... E21B 41/0007

* cited by examiner

*Primary Examiner* — Matthew R Buck
*Assistant Examiner* — Patrick F Lambe
(74) *Attorney, Agent, or Firm* — Egbert Law Offices, PLLC

(57) ABSTRACT

A process for installing the payload onto a subsea structure has the steps of affixing an adapter spool on to the subsea structure, deploying a plurality of winches in spaced relation to the subsea structure, connecting an end of a plurality of slings received on the plurality of sheaves to a plurality of winches, connecting an opposite end of the plurality of slings to the payload, lowering the payload in a direction toward the subsea structure, actuating the plurality of winches so as to draw the payload downwardly into a position on the subsea structure, and locking the payload onto the subsea structure. The adapter spool has a collar with a plurality of sheaves extending outwardly therefrom. The payload can be a capping stack and the subsea structure can be a blowout preventer.

14 Claims, 14 Drawing Sheets

PROCESS AND APPARATUS FOR INSTALLING A PAYLOAD ONTO A SUBSEA STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the installation of a payload, such as hardware and other equipment, in the subsea environment. More particularly, the present invention relates to the installation of the payload onto a wellhead, a blowout preventer or a lower marine riser package (LMRP). Additionally, the present invention relates to the installation of a payload while upforce pressures from a blowing well prevent conventional installation.

2. Description of Related Art Including Information Disclosed Under 37 CFR 1.97 and 37 CFR 1.98

As the worldwide demand for hydrocarbon fuel has increased, and known onshore reserves have not kept up with the demand, there has been increasing activity in offshore oil exploration and production. Reserves of oil known to exist in the offshore areas have steadily increased and an increasing percentage of world production is from these offshore areas. The offshore environment has presented numerous new challenges to the oil drilling industry which have been steadily overcome to allow efficient drilling and production in these areas, although the costs have been considerably higher than those of onshore operations.

Not only has the offshore environment made production more difficult to accomplish, it has also generally increased the risk of environmental damage in the event of a well blowout or other uncontrolled loss of hydrocarbons into the sea. As a result, known safety equipment, such as blowout preventers which have been used successfully in onshore operations, have been used in offshore operations also. In spite of safety precautions, blowouts of offshore oil wells are known to occur and will occur in the future.

Subsea drilling operations may experience a blowout, which is an uncontrolled flow of formation fluids into the drilling well. These blowouts are dangerous and costly, and can cause loss of life, pollution, damage to drilling equipment, and loss of well production. To prevent blowouts, blowout prevention equipment is required. This blowout prevention equipment typically includes a series of equipment capable of safely isolating and controlling the formation pressures and fluids at the drilling site. BOP functions include opening and closing hydraulically-operated pipe rams, annular seals, shear rams designed to cut the pipe, a series of remote-operated valves to allow control the flow of drilling fluids, and well re-entry equipment. In addition, process and condition monitoring devices complete the BOP system. The drilling industry refers to the BOP system as the BOP stack.

One of the problems associated with diverter systems for such blowout preventers is that, under certain circumstances, the pressure of the fluid released from the blowout preventer is of extremely high pressures, up to 15,000 p.s.i. Under such circumstances, if there is a release from the blowout preventer, or from the wellhead, these extreme pressure will cause boiling and turbulence in the water directly above the blowout preventer and/or wellhead. This boiling of hydrocarbons in the water directly adjacent to the oil platform is extremely hazardous. First, the amount of turbulence caused by such boiling makes it extremely difficult to carry out further repair activities. Under other circumstances, the presence of such hydrocarbons on the top of the water will create an extreme fire and explosion hazard. As such, it is extremely important so as to avoid the release of hydrocarbons from the subsea well such that the boiling action of the released hydrocarbons is diverted away from the offshore platform or from marine vessels associated therewith.

Whenever the pressure of the fluid released from the well is extremely high, it becomes very difficult to install payloads on the subsea structure. The blowing well will create oscillations in the payload which prevents centralization of the payload onto the subsea structure. The strong pressures will cause the payload, as it is being lowered, to vibrate and oscillate and to be deflected out of a central position above the subsea structure. As such, a need has developed so as to be able to deliver the payload to the subsea structure while compensating for the strong pressure that is released from the subsea well.

Whenever there is a plume of hydrocarbons, such as natural gas, at the surface of the body of water, it is important to maintain separation of the surface boil from personnel involved in the response. Furthermore, the surface boil will decrease the density of the water. This can cause vessels located within the surface boil to lose buoyancy and potentially sink. As such, when there is a plume of hydrocarbons at the surface of the body of water, vertical installation of the payload becomes virtually impossible.

When gas makes its way to the surface, station keeping in the surface boil becomes impossible. Vessels need to be positioned outside the perimeter of the plume. Gas expression on the surface makes the local environment hazardous for personnel. To mitigate this problem, personnel need to maintain separation of wind from the boil.

Under certain circumstances, the blowout can be contained through the use of a capping stack. The capping stack is the subject of various patents by the present Applicant. For example, U.S. Pat. No. 9,080,411, issued on Jul. 14, 2015 to the present Applicant, describes a subsea diverter system for use with a blowout preventer. This apparatus diverts fluid from a subsea well. A diverter is affixed between the upper and lower portions of the blowout preventer. Each of the upper portion and lower portion of the blowout preventer has a flow passageway extending vertically therethrough. The diverter has an interior passageway extending vertically therethrough in alignment with the flow passageway of the upper and lower portions of the blowout preventer. The diverter has a flowline communicating with the interior passageway and extends outwardly therefrom. The flowline has a valve thereon which is movable between an open position and a closed position. The open position is suitable for allowing at least a portion of the fluid from the flow passageway to pass outwardly of the flowline to a location remote from the blowout preventer.

U.S. Pat. No. 9,038,728, issued on May 26, 2015 to the present Applicant, describes a system and method for diverting fluids from a wellhead by using a modified horizontal Christmas tree. The system has a capping stack with a connector suitable for connection or interconnection to the wellhead, a flow base fixedly positioned in the subsea environment, and a conduit connected to the outlet of a diverter line of the capping stack and connected to the inlet of an interior passageway of the flow base. The conduit is suitable for passing fluids from the capping stack toward the flow base. The flow base is a modified horizontal Christmas tree.

U.S. Pat. No. 8,720,580, issued on May 13, 2014 to the present Applicant, also describes a system and method for diverting fluids from a damaged blowout preventer. The system has a capping stack with a connector suitable for connection to the blowout preventer, a flowing stack, and an intervention blowout preventer connected to the connector of the flowing stack. The capping stack as a fluid passage extending from the connector. The capping stack has at least one diverter line in communication with the fluid passage. The flowing stack has an interior passageway extending to the connector at an upper end thereof. The flowing stack has at least one pipe in communication with the interior passageway. The pipe is connected with the diverter line of the capping stack such that a flow fluid passing through the diverter line passes through the pipe into the interior passageway of the flowing stack.

U.S. Pat. No. 9,033,051, issued on May 19, 2015 to the present Applicant, teaches a system for diversion of fluid flow from a wellhead. The system has a mudline closure mechanism suitable for attachment to the wellhead, a blowout preventer connected or interconnected to the mudline control mechanism, and a flow control line having one end connected to a diversion passageway of the mudline control mechanism and extending therefrom such that an opposite end of the flow control line is disposed away from the mudline closure mechanism. The mudline closure mechanism has a main passageway communicating with the flow passageway of the blowout preventer. The mudline closure mechanism has a valve suitable for switching fluid flow from the main passageway to the diversion passageway. The blowout preventer is positioned above the mudline closure mechanism. The flow control line is supported by a base anchored to the subsea floor away from the mudline closure mechanism.

U.S. Patent Application Publication No. 2017/0350210, published on Dec. 7, 2017 to the present Applicant, teaches a rapid mobilization air-freightable capping stack system. This is a method and apparatus for transporting a capping stack for use in a subsea structure. This apparatus includes a capping stack having a capping stack spool, a connector body connected to the capping stack spool and at least one diverter leg connectable to the capping stack spool. A first skid receives the capping stack spool on the floor thereof. The second skid receives the connector body on a floor thereof. A third skid receives the diverter leg thereon. The first, second and third skids are adapted to be received within an interior of an aircraft. The skids and the connected components can then be flown by the aircraft to a desired location so as to be assembled at a location near a wellhead.

U.S. Pat. No. 9,359,852, issued on Jun. 7, 2016 to Kebadze et al., describes a system and method for tethering subsea blowout preventers to enhance the strength and fatigue resistance of subsea wellheads and primary conductors. The system for tethering a subsea blowout preventer includes a plurality of anchors disposed about the subsea blowout preventer and secured to the seafloor. In addition, the system includes a plurality of tensioning systems. One tensioning system is coupled to an upper end of each anchor. The system includes a plurality of flexible tension members. Each tension member extends from a first end coupled to the subsea blowout preventer to a second end coupled to one of the tensioning systems. Each tensioning system is configured to apply a tensile preload to one of the tension members.

Of course, one difficulty associated with any attempt to install the capping stacks of the present Applicant is when the well is blowing so as to create a large plume from the wellhead up to the surface of the water. Since the gases associated with the plume are extremely explosive and toxic, it is important to be able to install the capping stack without placing personnel in a hazardous position in relation to the plume. As such, it is necessary for all personnel associated with the installation of the capping stack to reside outside the plume. Unfortunately, the blowing well is usually at the center of the plume. As such, there is been a difficulty in installing the capping stack while, at the same time, maintaining personnel away from the plume.

Under certain circumstances, it is necessary to precisely and accurately control the installation of the capping stack onto the blowout preventer or the wellhead. This is quite difficult under those circumstances where a plume is created in the water. Under certain circumstances, the installation of the capping stack cannot be done from directly above the wellhead. The oscillations created by the pressures from the well onto the capping stack make centralization of the capping stack onto the mandrel of the blowout preventer or the lower marine riser package nearly impossible. As such, a need has developed to provide a process and apparatus whereby the capping stack can overcome the forces of the hydrocarbon release and also to centralize the capping stack upon the mandrel of the blowout preventer.

A particular problem occurs during the installation of capping stacks onto blowout preventers when the upthrust from the blowing well exceeds the mass of the capping stack. As such, any attempt to lower the capping stack from a surface location directly onto the top of the blowout preventer is thwarted because of the force of the plume of hydrocarbons being released from the blowing well. In any event, it is difficult to achieve precise alignment of the capping stack with the mandrel of the blowout preventer under these circumstances. As such, a need has developed so as to provide a way of accurately and controllably drawing the capping stack into position over the blowout preventer while the well is blowing.

It is an object of the present invention to provide a process and apparatus for offset positioning and drawdown installation of payloads upon subsea structures.

It is another object of the present invention to provide a process and apparatus whereby a payload can be effectively installed upon a wellhead, a blowout preventer or an LMRP by personnel away from the plume associated with a subsea blowing well.

It is still a further object of the present invention to provide a process and apparatus whereby the payload can be installed upon the wellhead, the blowout preventer or the LMRP without risk to the safety and health of workers associated with the subsea installation operation.

It is a further object of the present invention to provide a process and apparatus which stabilizes and centralizes the payload during the lowering of the payload in the plume.

It is still a further object of the present invention to provide a process and apparatus which avoids damage to the payload and to the subsea structure to which the payload is employed.

These and other objects and advantages of the present invention will become apparent from a reading of the attached specification and appended claims.

BRIEF SUMMARY OF THE INVENTION

The present invention is a process for installing a payload onto a subsea structure. The process comprising the steps of: (1) forming an adapter spool having a plurality of sheaves in spaced relation to each other and in which the adapter spool is adapted to lock onto the subsea structure; (2) affixing the adapter spool onto the subsea structure; (3) extending a plurality of slings respectively through the plurality of sheaves; (4) deploying a plurality of winches at opposite sides of the subsea structure on the seabed; (5) connecting an end of each of the plurality of slings to the plurality of winches; (6) connecting an opposite end of the plurality of slings to the payload; (7) lowering the payload in a direction toward the subsea structure; (8) actuating the plurality of winches so as to draw the payload in a position on the subsea structure; and (9) locking the payload to the subsea structure.

The adapter spool has a collar positioned between the plurality of sheaves. The collar locks onto the mandrel of the subsea structure. Each of the plurality of slings has a hookup connector at one end thereof. This hookup connector connects to a line extending from the winch.

In the present invention, the step of deploying can be from a barge or other vessel positioned in proximity over the subsea structure. The plurality of winches can be a pair of winches located approximately 180° apart relative to the subsea structure. The plurality of winches are deployed onto the seabed approximately one hundred feet away from the subsea structure. If necessary, more than two winches can be used so as to further enhance stabilization and guided lowering of the payload.

In the present invention, the subsea structure is a blowout preventer. The payload is a capping stack. The blowout preventer is affixed to a blowing well. An upthrust of the blowing well can be greater than the mass of the capping stack. The plurality of winches are positioned along a line perpendicular to a direction of approach by the barge or vessel. The step of actuating includes paying in the line of the winches and the plurality of slings so as to draw the line around the pair of sheaves so as to move the payload toward the subsea structure. The payload is moved toward the subsea structure with a remotely-operated vehicle (ROV).

The present invention is also an adapter spool for use with a subsea structure. The adapter spool includes a body having a collar formed centrally thereof, a first sheave positioned on one side of the collar, and a second sheave positioned on the collar away from the first sheave. The collar is adapted to engage with a mandrel of the subsea structure. Each of the first and second sheaves are rotatable about an axis transverse to a longitudinal axis of the collar.

In the adapter spool of the present invention, a first sling is received over the first sheave and a second sling is received over the second sheave. Each of the first and second slings has a hookup connector at an end thereof.

This foregoing Section is intended to describe, with particularity, the preferred embodiments of the present invention. It is understood that modifications to this preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
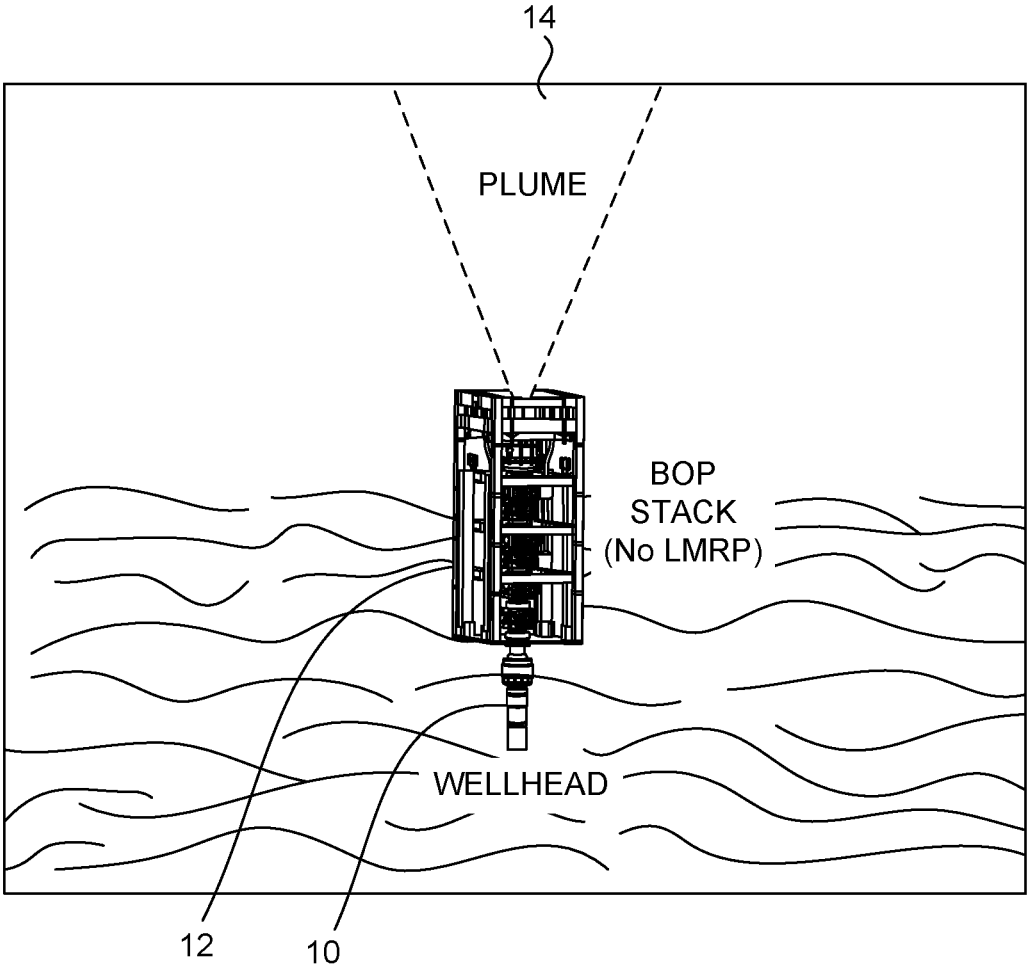
FIG. 1 is a perspective view showing the plume released from a blowout preventer associated with a subsea blowing well.

Referring to FIG. 1, it can be seen that there is a wellhead 10 that is blowing. In particular, a blowout preventer 12 is affixed to the wellhead 10. The blowout preventer is open so that a plume 14 of hydrocarbons is released from the upper end of the blowout preventer 12. The plume 14 is released in such a manner so as to spread out in a conical manner. As such, the surface of the body of water in which the blowout preventer 12 is positioned will have a large amount of boiling hydrocarbons.

In normal operations, it is important for workers to avoid any activities located within the danger zone of the plume at the surface of the body of water. As such, a need has developed whereby a payload can be installed onto the blowout preventer by personnel located away from the plume. For example, a series of barges can extend in a linear fashion into the plume and then a downline can extend from the end of the plurality of barges so as to allow for a installation of equipment onto the blowout preventer 12. However, under certain circumstances, the force of the hydrocarbon release in the plume 14 will prevent this vertical installation technique. In other words, the force of the upthrust of the plume 14 will prevent the payload from being placed directly in its desired location upon the blowout preventer. As such, the present invention provides a technique for the installation of a payload onto a subsea structure from a location away from the plume. The present invention also overcomes the forces of the released hydrocarbons upon the payload. The present invention also centralizes the payload relative to the mandrel of the subsea structure.

Figure 2:
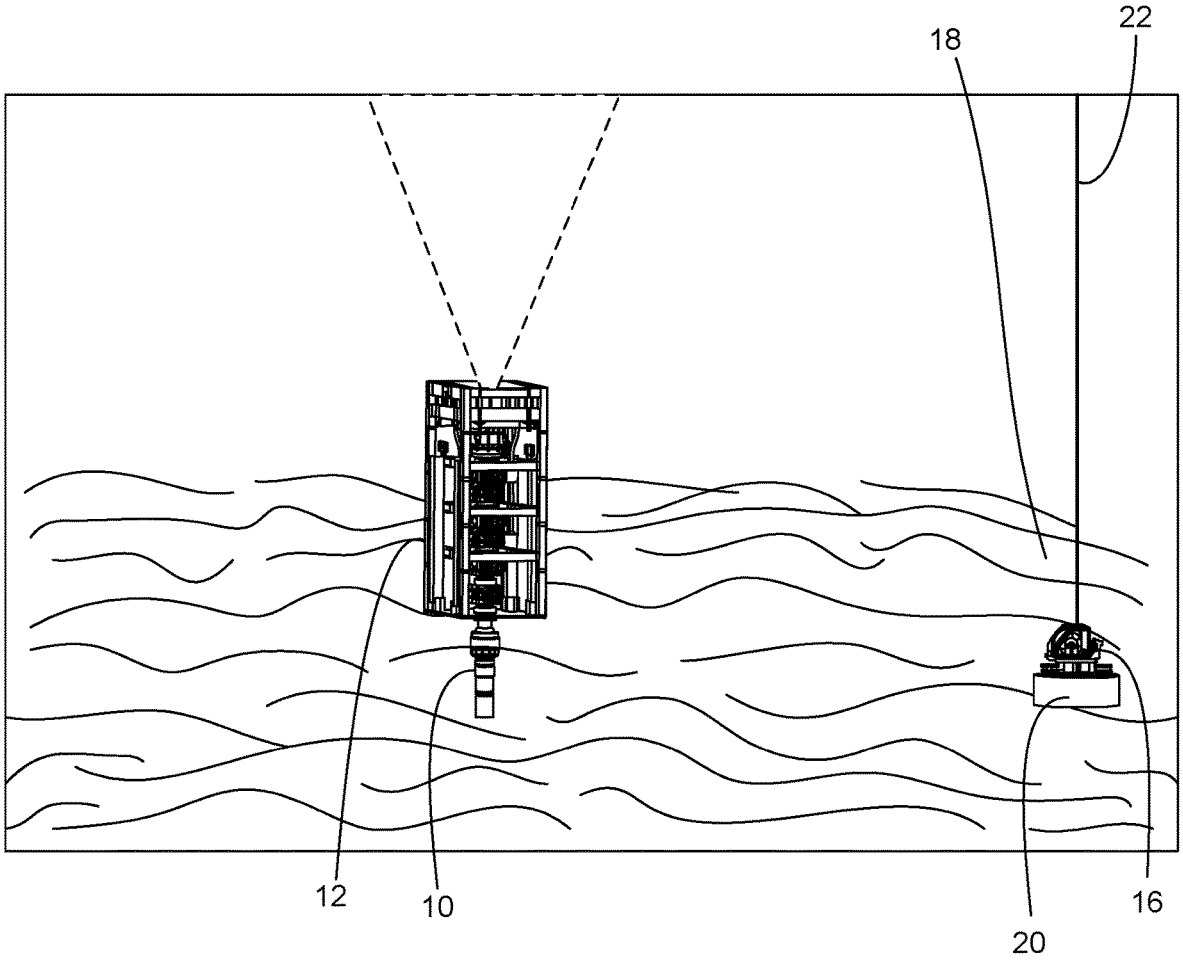
FIG. 2 shows a perspective view of an initial step of the process of the present invention.

FIG. 2 shows an initial step in the process of the present invention. In FIG. 2, a subsea winch 16 has been lowered onto the seabed 18. The subsea winch 16 will have a clump weight 20 at the bottom thereof. A cable 22 can be used to lower the winch 16 to the seabed 18. The winch 16 will have a line thereon which, as will be described hereinafter, can be extended so as to perform the operation required by the present invention. The winch 16 will be positioned on one side of the blowout preventer 12. The winch 16 will be approximately one hundred feet away from the wellhead 10.

Figure 3:
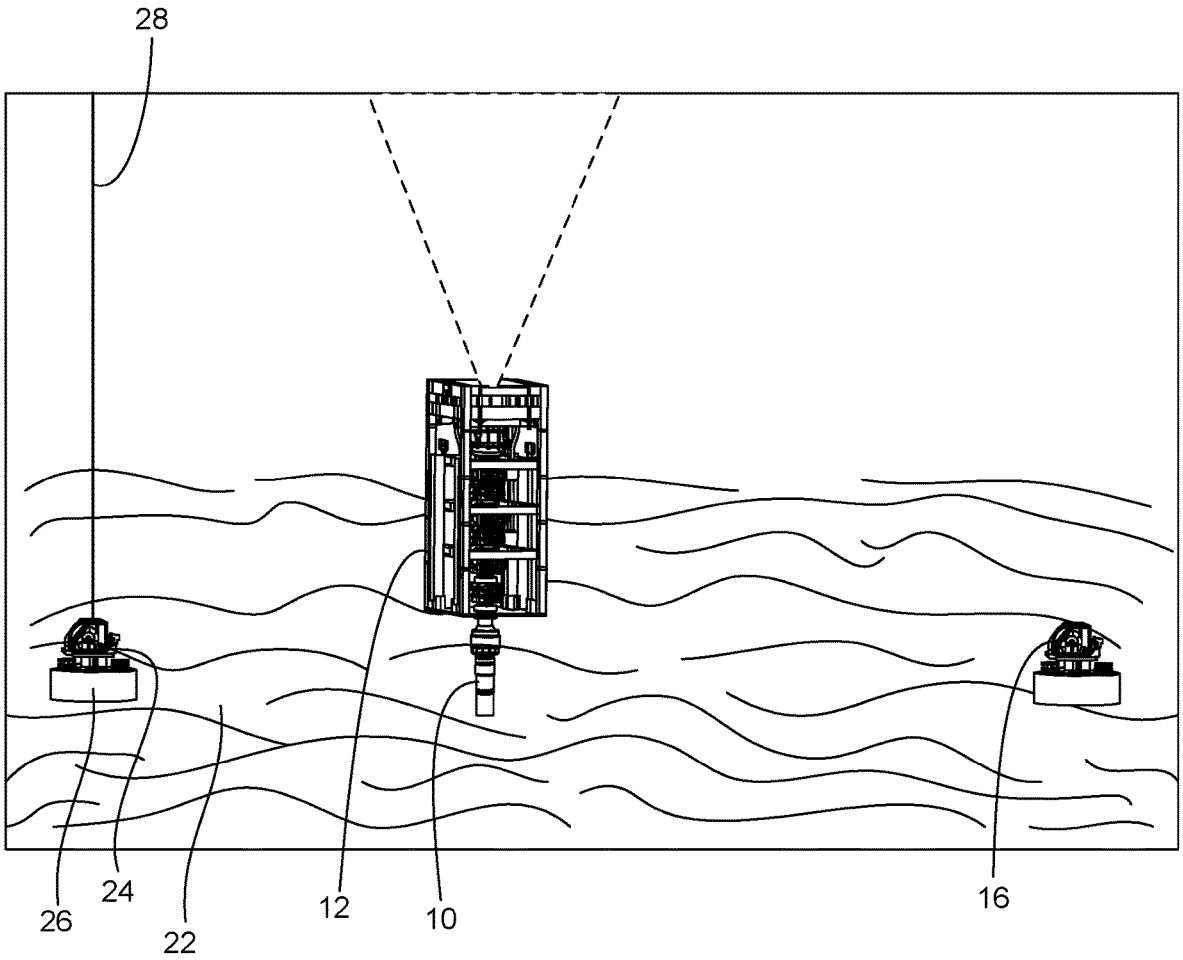
FIG. 3 is a perspective view showing a subsequent step of the process of the present invention.

FIG. 3 shows the next step of the process of the present invention. In FIG. 3, it can be seen that there is a second winch 24 that has a clump weight 26 at the bottom thereof. The second winch 24 is lowered to the seabed 22 by a cable 28. Winch 24 is positioned on an opposite side of the blowout preventer 12 and also approximately one hundred feet from the wellhead 10. Winches 16 and 24 will be on a line that is perpendicular to the direction of approach of the barge at the surface of the body of water. The winches 16 and 24 can be lowered from the barge or can be lowered from other vessels positioned outside of the plume at the surface of the body of water. Winch 24 will also have a line that can be utilized in the process of installing the capping stack.

Figure 4:
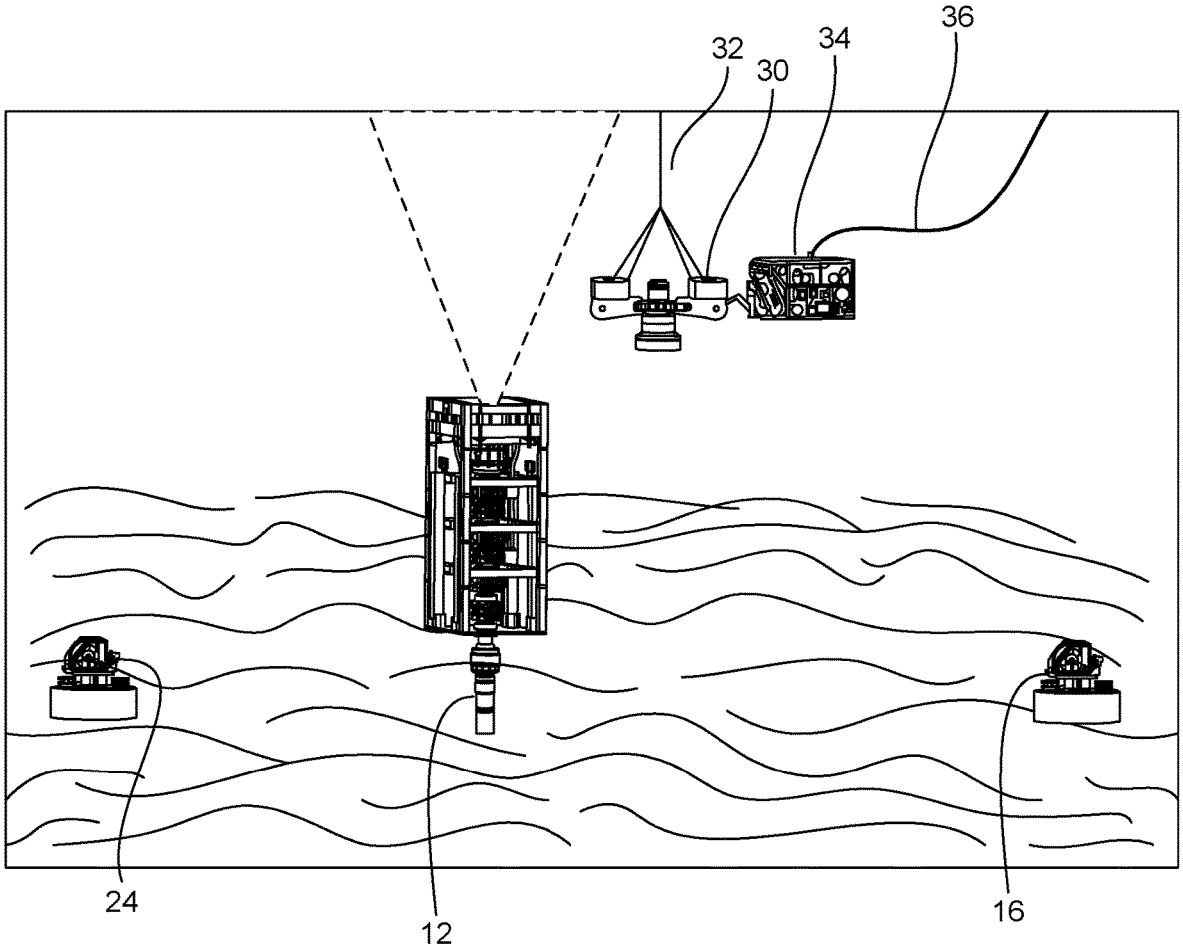
FIG. 4 is a perspective view showing of further step in the process of the present invention.

FIG. 4 shows a further step of the process of the present invention in which an adapter spool 30 is lowered by a cable 32 toward the blowout preventer 12. An ROV 34 can be employed so as to suitably grasp the adapter spool 30 for the purposes of moving the adapter spool toward the blowout preventer 12. The ROV 34 can be controlled from a surface location by signals through a tether or umbilical 36. The adapter spool 30, as will be described hereinafter, is to be installed onto the mandrel of the blowout preventer 12. The adapter spool 30 has at least two sheaves in spaced relation around the outer diameter of the adapter spool 30. At least a pair of soft slings are pre-wired through the sheaves. The two soft slings have hook-up connectors at each end. Suitable oceangoing barges, as described hereinbefore, can be utilized so as to facilitate the installation of the adapter spool.

Figure 5:
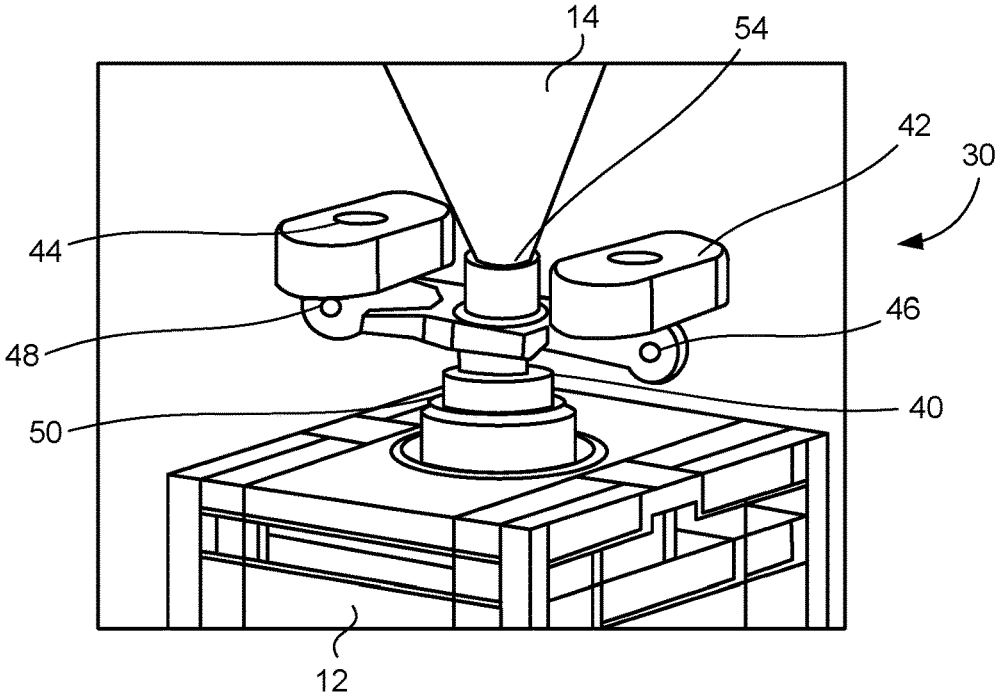
FIG. 5 is perspective view showing the adapter spool as positioned over the mandrel of a blowout preventer.

FIG. 5 shows the adapter spool 30 of the present invention. The adapter spool 30 includes a collar 40 formed centrally thereof. A first sheave 42 is located on one side of the collar 40. Another sheave 44 is located on an opposite side of the collar 40. If necessary, additional sheaves can be utilized on the adapter spool 30. The collar 40 is adapted to be locked onto the mandrel 50 of the blowout preventer 12. The body of the adapter spool 30 has a bore 52 formed centrally thereof. Bore 52 is illustrated as being open so that the plume 14 can pass therethrough when the adapter spool 30 is secured to the mandrel 50 of the blowout preventer 12. As such, the bore 52 should be open during installation. The collar 40 can have an automatic locking feature so that the adapter spool 30 is secured to the mandrel 50 upon engagement therewith. Otherwise, the ROV can be used so as to properly manipulate and lock the collar 40 in its proper position. FIG. 5 further shows that the sheaves 42 and 44 have an axis of rotation that is transverse to the longitudinal axis of the collar 40.

Figure 6:
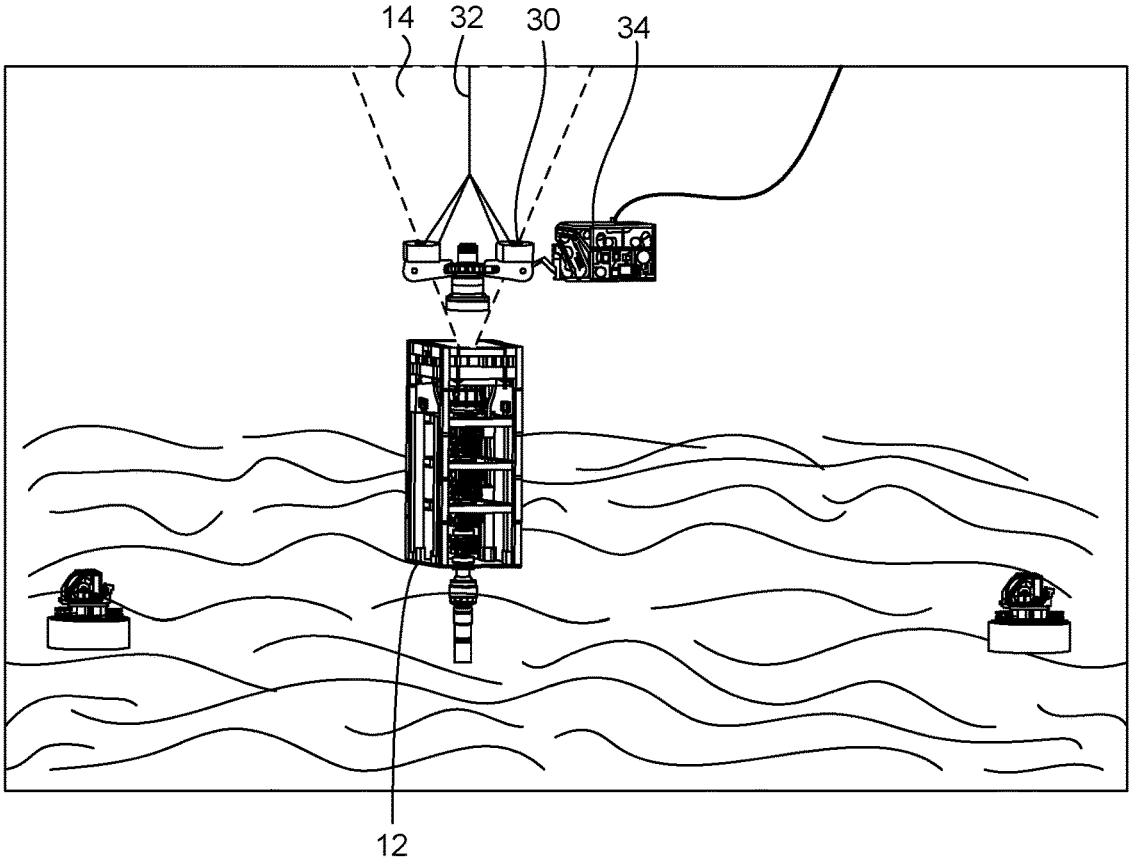
FIG. 6 is perspective view showing a further step in the installation of the adapter spool sling setup in accordance with the present invention.

FIG. 6 shows a further step in the process of installation. In FIG. 6, it can be seen that the adapter spool 30 is moved by the ROV into the plume 14. In FIG. 4, the adapter spool 30 is positioned outside of the plume 14. In FIG. 6, the ROV 34 has moved the adapter spool 30 into the plume and into a position above the blowout preventer 12. Cable 32 (extending from the barge at the surface location) will support the adapter spool 30 in its proper position both within the plume 14 and over the blowout preventer 12. Since the bore 52 of the adapter spool 30 is open, hydrocarbons in the plume 14 will pass freely therethrough even when the adapter spool 30 is supported above the mandrel of the blowout preventer 12.

Figure 7:
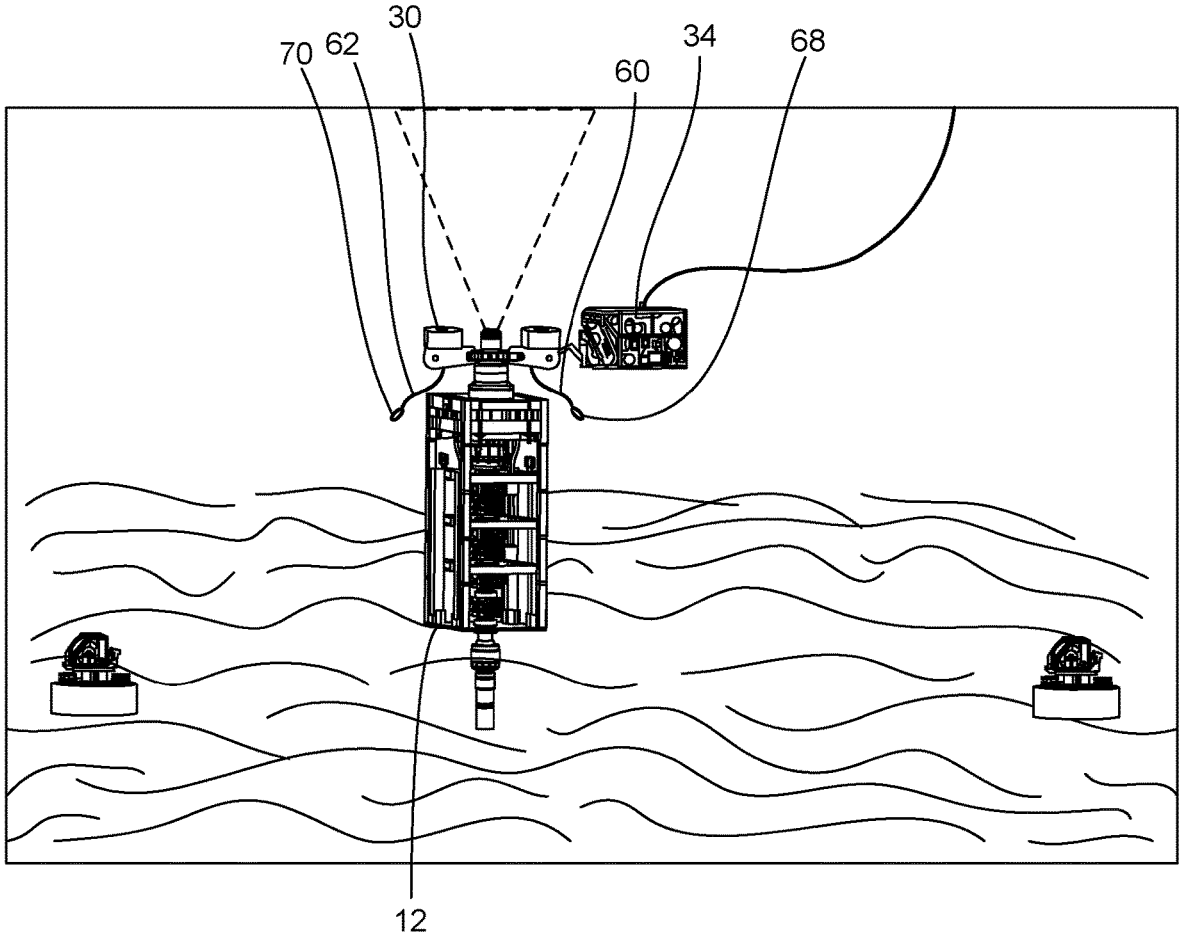
FIG. 7 is a perspective view showing a still further step in the process of installing the adapter spool sling setup of the present invention.

FIG. 7 illustrates that the ROV 34 has manipulated the adapter spool 30 so as to clamp onto the mandrel 50 of the blowout preventer 12. The slings 60 and 62 are pre-wired through the sheaves of the adapter spool 30. Sling 60 has a hook-up connector 68 at an end thereof. Similarly, sling 62 will have a hook-up connector 70 at an end thereof.

Figure 8:
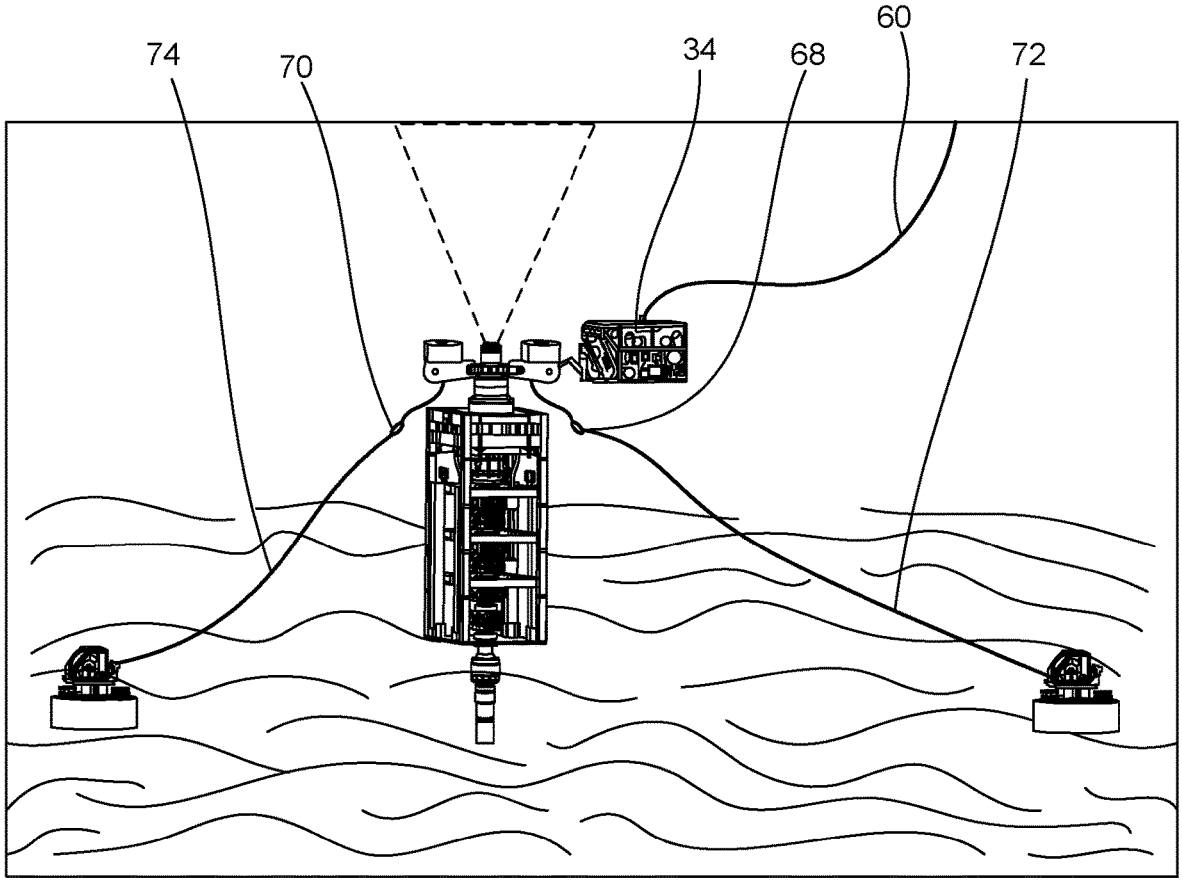
FIG. 8 is a still further view showing the installation of the adapter spool sling setup of the present invention.

FIG. 8 shows that the line 72 extending from the first winch 16 has an end that is joined to the hook-up connector 68 of the sling 60. Similarly, the second winch 24 has line 74 connected to the hook-up connector 70 of sling 62. This connection can be made by the operation of the ROV 34. In this position, the line 74 is strongly secured to the sling 62 and the line 72 is secured to the sling 60.

Figure 9:
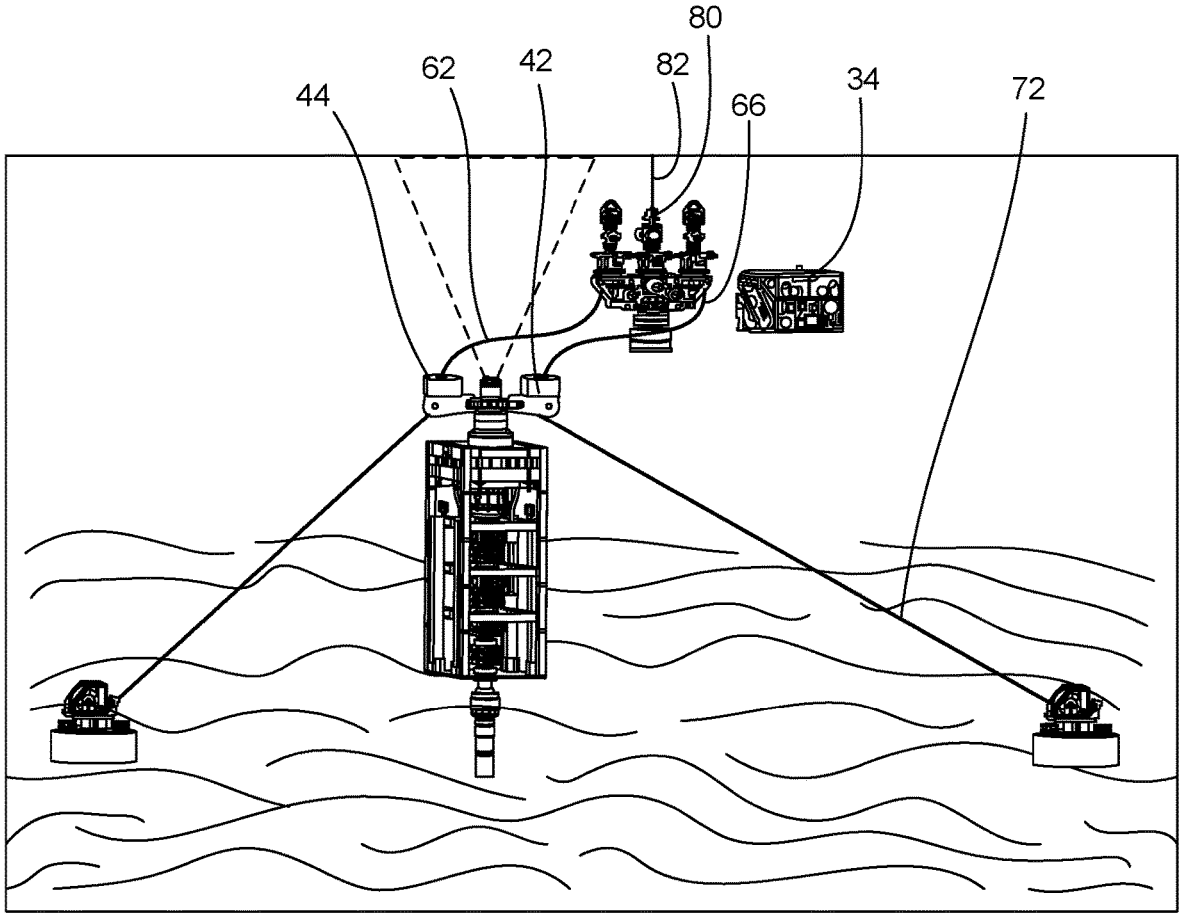
FIG. 9 of is a perspective view showing the drawing of the blowout preventer into proximity of the mandrel of the blowout preventer.

FIG. 9 illustrates that there is a payload 80, such as a capping stack, that is supported by a cable 82 extending from a surface location (such as the barge at the surface of the body of water). Sling 66 extends through the sheave 42 and connects to one side of the payload 80. The winch 16 can be operated so as to pay out the line 72 so as to accommodate the joining of the sling 66 the payload 80. Similarly, the sling 62 is connected to an opposite side of the payload 80. Sling 62 extends through the sheave 44. The line 74 is payed out from the winch 24. The ROV 34 can manipulate the payload 80 so as to be in a proper position over the mandrel of the blowout preventer 12.

Figure 10:
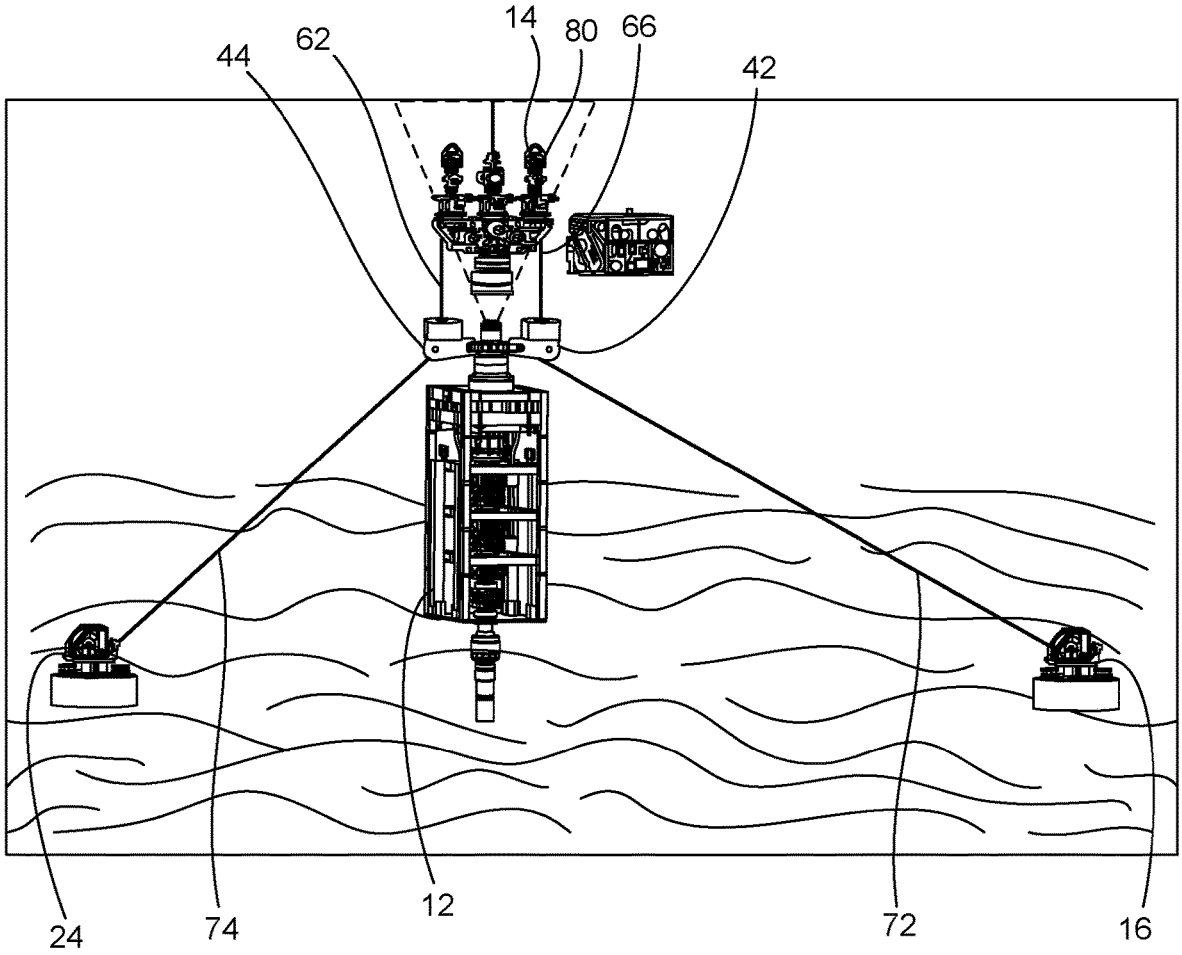
FIG. 10 is a perspective view showing the step of the process of the present invention in which the payload is located directly over the top of the mandrel of the blowout preventer in the plume.
Figure 11:
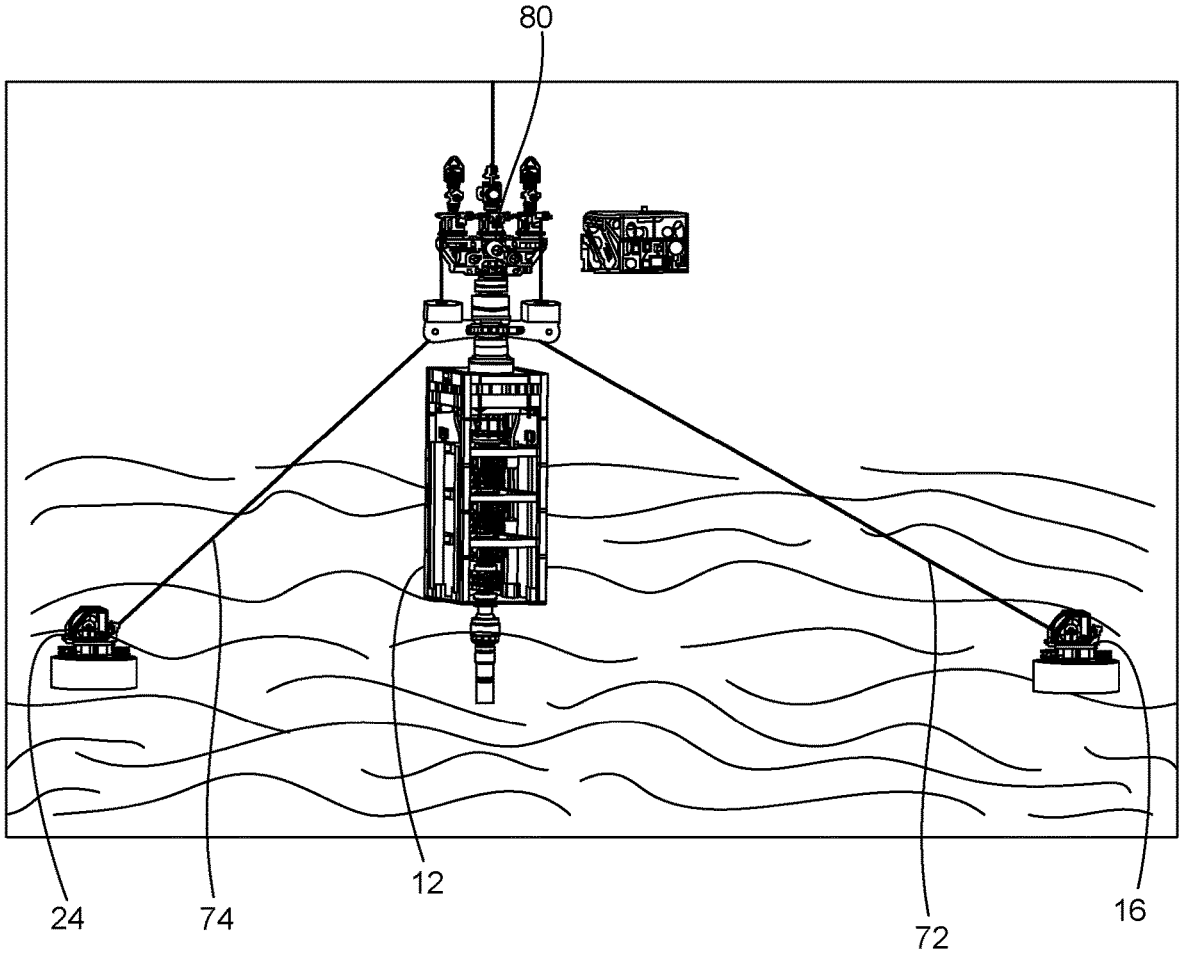
FIG. 11 is a perspective view showing the drawing of the payload onto and in position onto the blowout preventer of the blowing well.

FIGS. 10 and 11 show that the winches 16 and 24 are actuated so as to pay in the respective lines 72 and 74. This will tension the slings 66 and 62 in the respective sheaves 42 and 44. As such, the payload 80 is forcefully drawn into a precise position over the mandrel of the blowout preventer 12. The payload 80, because of the tension produced by the winches 16 and 24, can be properly installed despite the upthrust forces of the plume 14. Because of the precise positioning of the sheaves 42 and 44 and the fastening of the collar of the adapter spool 30 onto the mandrel of the blowout preventer 12, the payload 80 can be accurately and precisely aligned with the mandrel of the blowout preventer 12. The tension created by the winches also centralized the payload and minimizes oscillations in the payload.

Figure 12:
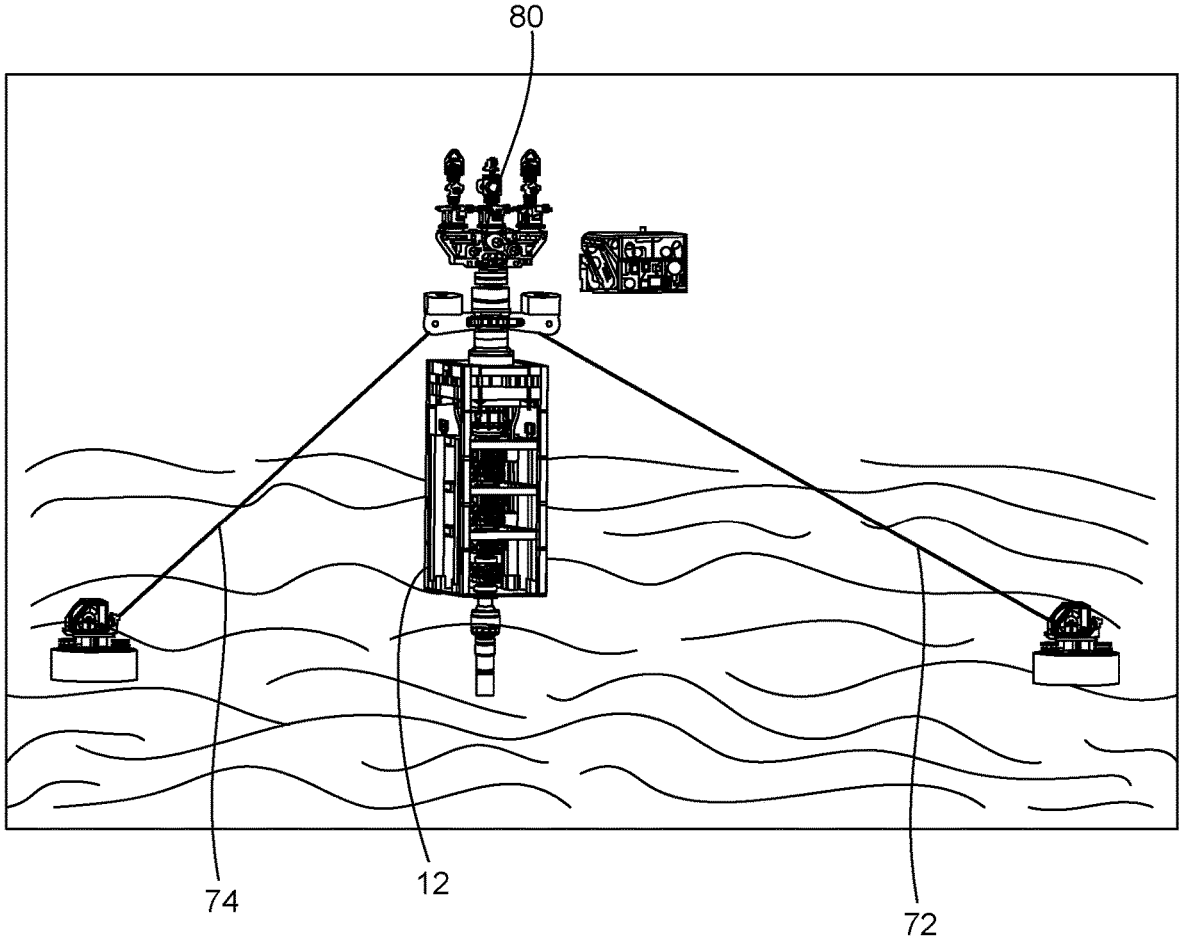
FIG. 12 is the final step in the process of the present invention in which the payload is secured to the mandrel of the blowout preventer.

FIG. 12 shows the final step in the affixing of the payload 80 onto the blowout preventer 12. In particular, the lines 72 and 74 have been pulled to their furthest extent so that the automatic locking mechanism of the payload 30 securely engages with the mandrel of the blowout preventer 12. The payload 80, such as the capping stack, is now in operation for diverting fluids from the blowing well or by closing the well in the manner described in the previous patents to the present Applicant.

In this configuration, the installation allows personnel to operate outside of the plume and the danger zone of the plume. The winches can be operated remotely so that is not necessary for personnel to be within the plume of hydrocarbons released from the blowing well. All of the lowering of the various components of the process of the present invention can be carried from a barge located within the plume (and without personnel thereon). The arrangement of the adapter spool assures that the capping stack can be applied onto the blowout preventer despite the upthrust forces from the plume released from the blowing well. The adapter spool assures a precise alignment during installation. As such, the capping stack can be properly installed while avoiding danger to personnel located near the plume at the surface of the body of water.

Figure 13:
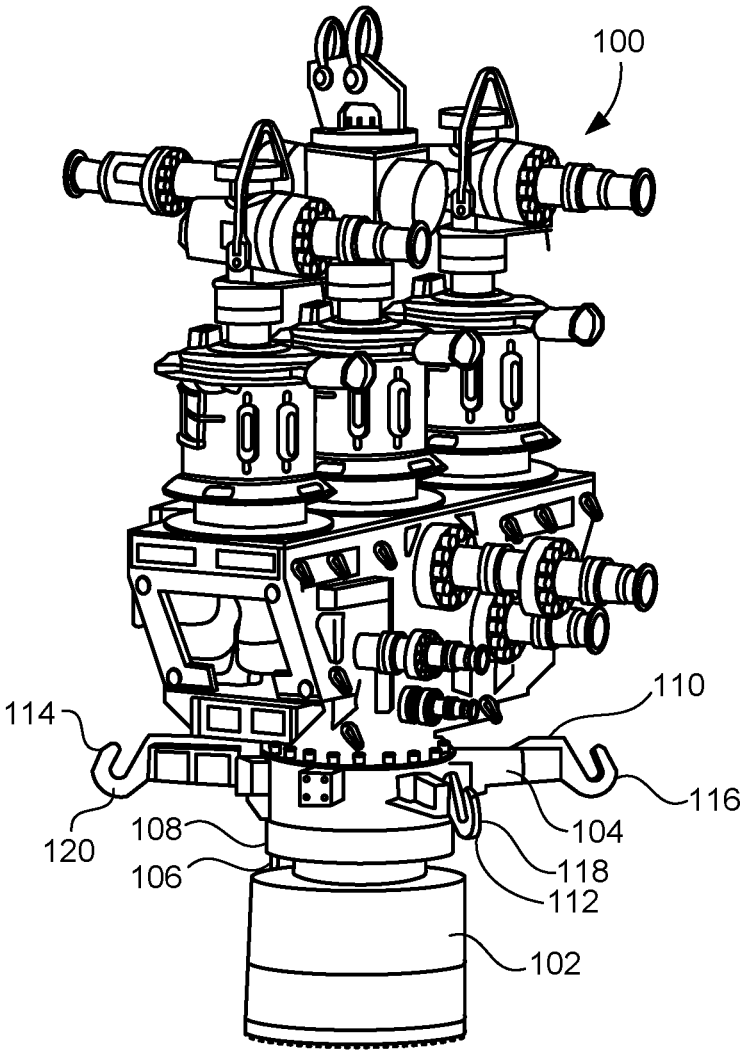
FIG. 13 is a perspective view of a capping stack with spider adapters mounted to the capping stack above the connector.

Referring to FIG. 13, there shown a capping stack 100 which serves as the payload to the process of the present invention. Capping stack 100 has a wellhead connector 102 at its bottom. So as to facilitate connection of the capping stack 100 to the slings, a spider adapter 104 is secured around the low diverter spool flange 106 of the capping stack 100. In particular, a spider adapter 104 is secured around the low diverter spool flange 106 of the capping stack 100 wellhead connector 102. Multiple spider adapters 110, 112 and 114 are bolted to the ring and extend outwardly therefrom. The arms 110, 112 and 114 have a U-shaped hooks 116, 118 and 120 at the ends thereof. These hooks 116, 118 and 120 serve to establish tie-in points for the stabilizer system. In an alternative embodiment of the present invention, the stabilizer and slings are installed prior to subsea deployment.

Figure 14:
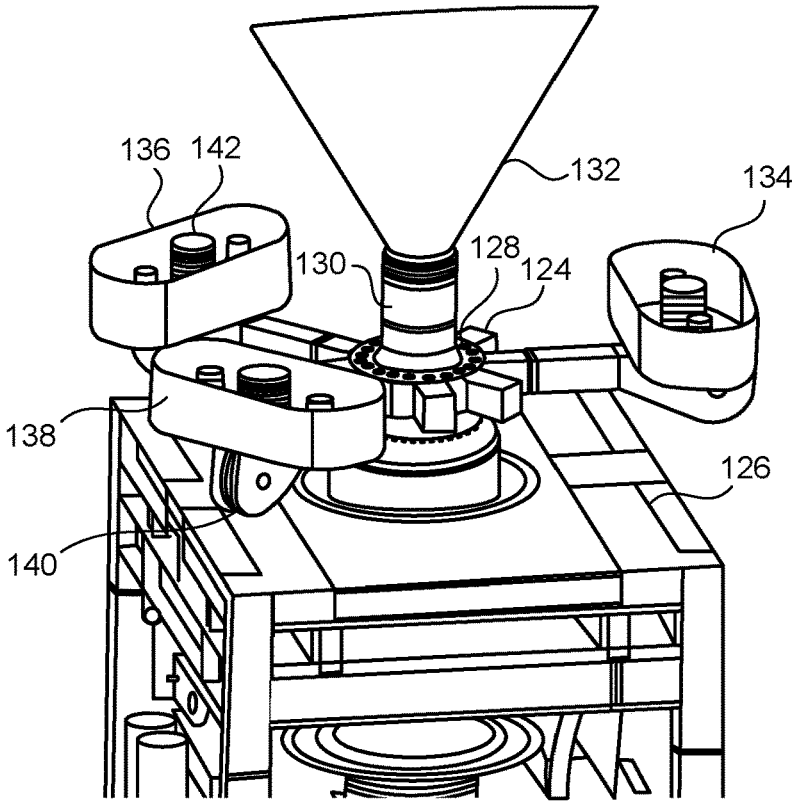
FIG. 14 is a perspective view of an adapter spool as position on the mandrel of a subsea structure.

FIG. 14 shows an alternative in embodiment of the adapter spool 124 as used on the subsea structure 126 of the present invention. In particular, it can be seen that there is a ring 128 that is secured around the mandrel 130 of the subsea structure 126. A plume 132 is being released from they bore and through the mandrel 130. Sheave assemblies 134, 136 and 138 extend outwardly from ring 128. In particular, the sheave assemblies 134, 136 and 138 are shown with the sheaves 140 at a bottom thereof. In other words, each of the slings will thread through a funnel 142 and over the sheaves 140. In this embodiment, the slings can be pre-installed prior to subsea deployment.

Figure 15:
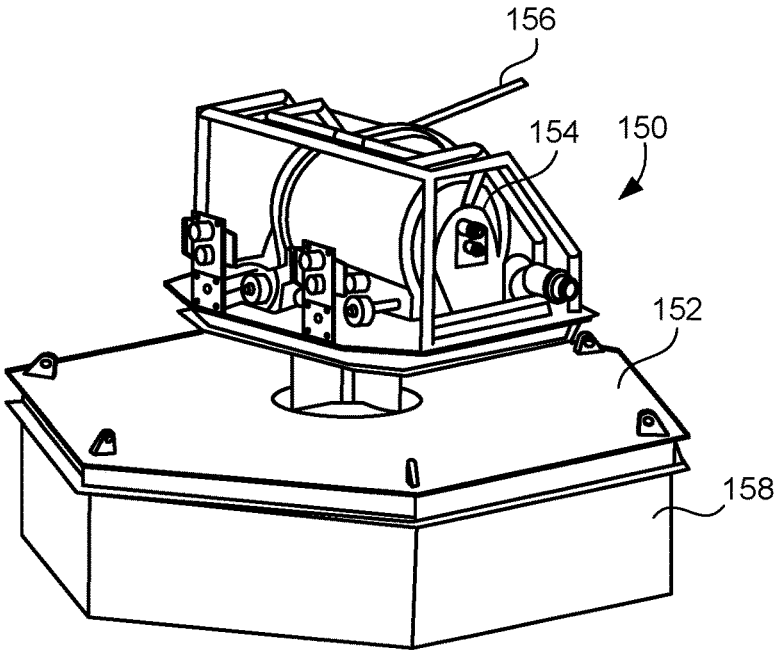
FIG. 15 is a perspective view of the subsea winch in accordance with the present invention.

FIG. 15 shows one of the winches 150 as used in the present invention. The winch 150 is a subsea hydraulic winch. In particular, winch 150 has a API 17H Class 5 or 6 rotary torque bucket and gearbox. There is a mechanical wave gear on the drum with a gear ratio of 13.75 to 1. A chain-driven lever wind assists in slang winding. The winch 150 has a seventeen ton tension capacity as a drawdown forced. Two five inch hydraulic cylinders serve to create the final tension and lock in of the payload to the subsea structure. The sling 150 has a swivel base 152 to adjust the drum 154 and sling 156 heading. There is a 0 to 90° fleet angle for the sling 156. The clump 158 is a 40 ton concrete-filled clump with a mudmat.

Figure 16:
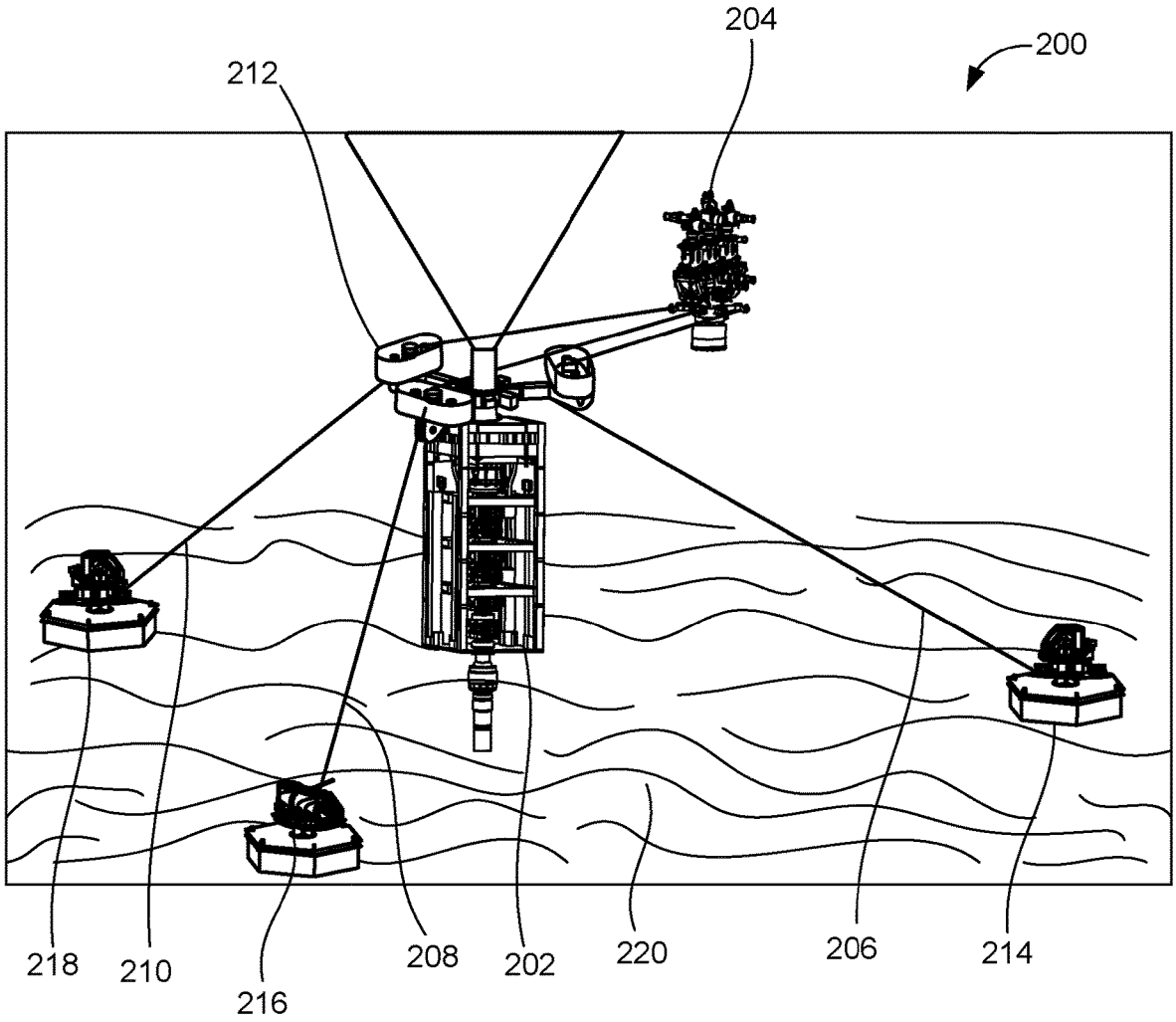
FIG. 16 shows an alternative embodiment for the installation of a payload onto a subsea structure.

FIG. 16 shows this alternative embodiment of the present invention. In particular, the system 200 has a subsea structure 202 and a payload 204. Slings 206, 208 and 210 are affixed to the spider adapters on the low diverter spool flange (as shown in FIG. 13) of the payload 204. The installation of the adapters onto the payload flange occurs on the surface location prior to subsea deployment. The adapter spool 212 (as shown in FIG. 14) receives the slings 206, 208 and 210 through the respective sheaves thereof. Winches 214, 216 and 218 are located at the seafloor 220. Winch 214 serves to pay in slung 206. Winch 216 serves to pay in sling 208. Winch 218 serves to pay in sling 210. As the various lines are being payed in, the payload 204 is being drawn to the mandrel of the subsea structure 202 (in the manner described herein previously). The slings 206, 208 and 210 are pre-loaded into the payload 204 and pre-loaded through the adapter the sheaves of the adapter spool 202 and to the winches 214, 216 and 218 prior to deployment.

The foregoing disclosure and description of the invention is illustrative and explanatory thereof. Various changes in the details of the illustrated and the construction and described method can be made is the scope of the present claims without departing from the true spirit of the invention. The present invention should only be limited by the following claims and their legal equivalents.

We claim:

1. A process for installing a payload onto a subsea structure, the process comprising:

affixing an adapter spool onto the subsea structure, the adapter spool having a bore and a plurality of sheaves thereon, each of the plurality of sheaves having a sling thereon;

deploying a plurality of winches in spaced relation to the subsea structure;

connecting an end of each of the plurality of slings to the plurality of winches;

connecting an opposite end of the plurality of slings to the payload;

lowering the payload in a direction toward the subsea structure;

actuating the plurality of winches so as to draw the payload into a position on the subsea structure; and engaging the payload onto the subsea structure with a locking mechanism.

2. The process of claim 1, the adapter spool having a collar with the plurality of sheaves extending outwardly therefrom, the step of affixing comprising:

locking the collar onto a mandrel of the subsea structure.

3. The process of claim 1, each of the plurality of slings having a hookup connector at one end thereof, the step of connecting an end of each of the plurality of slings comprising:

connecting the hookup connector to a line extending from the winch.

4. The process of claim 1, the step of deploying comprising:

deploying the plurality of winches from a vessel positioned over the subsea structure.

5. The process of claim 1, the step of deploying comprising:

lowering the winches from a surface location; and positioning the winches on opposite sides of the subsea structure.

6. The process of claim 5, the sling being connected to the payload and to the adapter spool prior to the step of lowering the payload.

7. The process of claim 1, the subsea structure being a blowout preventer, the payload being a capping stack.

8. The process of claim 7, the blowout preventer being affixed to a blowing well, an upthrust of the blowing well being greater than a mass of the capping stack.

9. The process of claim 5, the step of positioning comprising:

positioning the plurality of winches along a line perpendicular to a direction of approach by a vessel.

10. The process of claim 1, the step of actuating comprising:

paying in the plurality of slings so as to drive the plurality of slings around the respective plurality of sheaves so as to move the payload downwardly toward the subsea structure.

11. The process of claim 1, further comprising:

moving the payload toward the subsea structure with a remotely-operated vehicle.

12. The process of claim 1, the payload having a bore therein, the process further comprising:

affixing a spider adapter around a low diverter spool flange of the payload, the spider adapter have arms extending outwardly therefrom, the plurality of slings being secured to the spider adapter.

13. The process of claim 1, further comprising:

joining a line from each of said plurality of winches respectively to said plurality of slings.

14. The process of claim 1, further comprising:

removing the adapter spool from the subsea structure.

* * * * *